United States Patent [19]

Howorth

[11] Patent Number: 4,650,171

[45] Date of Patent: Mar. 17, 1987

[54] AUTOPSY TABLE

[75] Inventor: Frederick H. Howorth, Ollerton, Near Chorley, England

[73] Assignee: Howorth Air Engineering Limited, Bolton, England

[21] Appl. No.: 665,617

[22] Filed: Oct. 29, 1984

Related U.S. Application Data

[63] Continuation-in-part of Ser. No. 475,919, Mar. 16, 1983, abandoned.

[30] Foreign Application Priority Data

Mar. 25, 1982 [GB] United Kingdom ..... 8208815
Mar. 25, 1982 [GB] United Kingdom ..... 8208845

[51] Int. Cl.[4] ..... A61G 13/00

[52] U.S. Cl. ..... 269/322; 128/1 R; 128/139; 269/327

[58] Field of Search ..... 269/15, 322, 327; 98/36, 115 R; 128/1 R, 1 B, 139; 27/21; 422/104

[56] References Cited

U.S. PATENT DOCUMENTS 4,038,974 8/1977 Pielkenrood ..... 128/1 R
4,140,105 2/1979 Duvlis ..... 128/1 R

FOREIGN PATENT DOCUMENTS 1579226 11/1980 United Kingdom .

*Primary Examiner*—Frederick R. Schmidt
*Assistant Examiner*—Judy J. Hartman
*Attorney, Agent, or Firm*—Ross, Ross & Flavin

[57] ABSTRACT

A table top is provided, at least along one side, with a number of sockets into which air entry devices or blanking units are fitted, as required. In use the air entry devices project above the table top and have openings facing inwardly of the table top. The sockets lead to an exhaust duct and when a body lying on the table top is being dissected, an extractor fan located in the duct is switched on to draw air across the table top, into the devices and through filters for exhaustion via the duct. This pattern of air flow minimizes the likelihood of an operator inhaling noxious substances or gases from the body, and the devices do not impede access to the body by the operator.

The air entry devices may be slideably adjustable in the sockets or else provided in a range of lengths and be interchangeable so that they can be arranged at optimal levels above the table top.

10 Claims, 8 Drawing Figures

AUTOPSY TABLE

RELATED APPLICATIONS

This application is a continuation-in-part of my earlier application Ser. No. 475,919, filed Mar. 16, 1983, now abandoned.

TECHNICAL FIELD

The invention relates to an autopsy table, that is to say a table specifically adapted to accommodate a body, or a tray on which a body is disposed, while a post-mortem examination is being carried out.

BACKGROUND ART

It is nowadays generally accepted that it is desirable to provide some form of air exhaust system in conjunction with an autopsy table to entrain any noxious substances, including gases, emitted from the body away from an operator and thereby minimize his/her chances of infection and contamination.

Probably the most well known and long-established type of autopsy table hitherto used in a simple ceramic slab with no air exhaust system at all. However, more recently, a stainless steel table with a discontinuous or perforated surface has been introduced. This table usually has air exhausted vertically downwards through the surface to a duct in the floor and subsequently via an exhaust fan and a filter out of the building to the external atmosphere. Cleaning of the perforated surface is difficult, which in itself leads to hazards of contamination. Also air exhaustion is not satisfactory as many of the perforations are at least partially blocked off by the body being examined or substances emanating from that body.

Either of the aforesaid tables may be used in conjunction with an overhead canopy which supplies sterile or conditioned air in a downward direction to the table. However, after careful research it has been shown that such an air flow arrangement causes undesirable turbulence around the face of an operator carrying out an examination on the table. This turbulence may, of course, have the deleterious effect of increasing the chance of the operator inhaling dangerous bacteria or gases which are often emitted from the body during an autopsy.

Also, both the aforesaid types of autopsy table have generally been fixed in position in a post-mortem room. Although tables which include an exhaust duct beneath the table top may be swung about a vertical axis provided by said duct, they cannot be removed from the duct because the duct is always internally contaminated with, for example, bacteria.

OBJECTS OF THE INVENTION

The primary object of the present invention is to provide an autopsy table having an air exhaust system which reduces to a minimum the likelihood of an operator inhaling noxious substances and gases emitted from a body being examined but which at the same time allows easy access to said body. Other aims are to provide a table with a surface which is easier to clean than known perforated or discontinuous surfaces and a table which may safely be removed from its associated exhaust duct.

There is also a need for an autopsy table which can be moved from one location to another, e.g. from one part of the post-mortem room to another to permit flexibility in the use of the table, especially for example, when the table is to be used for the examination of a body for teaching purposes. It would also be advantageous to be able to move an autopsy table away from associated components such as an exhaust duct and/or a sink for maintenance and repair of these components. However, as mentioned, it would only be safe to remove a table from an associated exhaust duct if the duct was not internally contaminated.

SUMMARY OF THE INVENTION

The invention proposes an autopsy table comprising a continuous, substantially rectangular table top having, adjacent at least one longitudinal side, one or more sockets which connect to an air extraction duct and at least one hollow air entry device with an opening facing inwardly of the table top fitted into one of these sockets, an extractor being provided in the air extraction duct and being operative to draw air transversely across the surface of the table top and through the air entry device or devices for exhaust via the duct.

The table top is continuous to facilitate cleaning and preferably sloping to facilitate drainage.

In a preferred practical embodiment of the autopsy table of the invention a number of elongate sockets are located adjacent each opposing longitudinal edge of the table top.

Optionally, there may also be a socket or a row of sockets at one or both ends of the table top.

It is envisaged that, within the scope of the invention, a plurality of entry devices of differing heights and/or curvatures may be provided, which devices may be removed from the sockets and interchanged as desired. A plurality of removable caps, covers or blanking units should, of course, be provided to block off any socket in which a device is not required to be fitted.

However, most advantageously a number of slideable entry devices are provided such that the height of each extending above the relevant socket is adjustable and an overhanging top thereof blocks off the socket when the device is withdrawn as far as possible into the passageway beneath the socket.

Filter means, preferably comprising a pre-filter and a HEPA (high efficiency particulate air) filter, are advantageously located between the entry device or devices and the extractor.

The extractor is conveniently an electrical fan.

The table may optionally be movable by means of castors fitted adjacent each lower corner of the table structure.

Finally, the table may be connected to the sink of a service unit by an inverted channel section linking one end of the table to one side of the sink.

BRIEF DESCRIPTION OF DRAWINGS

The invention will be described further, by way of example, with reference to the accompanying drawings in which.

DETAILED DESCRIPTION OF ILLUSTRATING EMBODIMENTS

Figure 1:
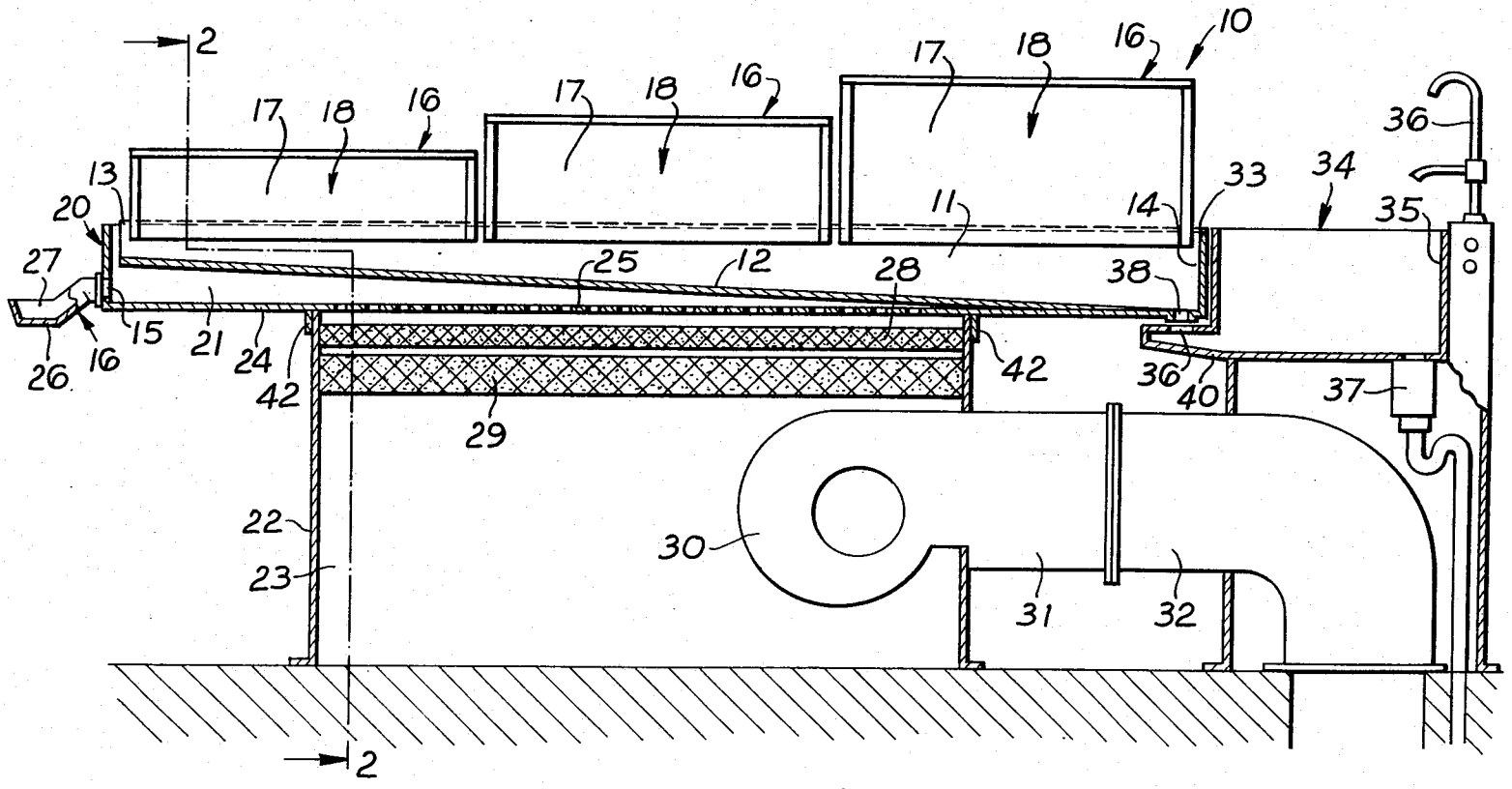
FIG. 1 is a longitudinal cross-section of a first practical embodiment of the autopsy table of the invention together with a service unit.
Figure 2:
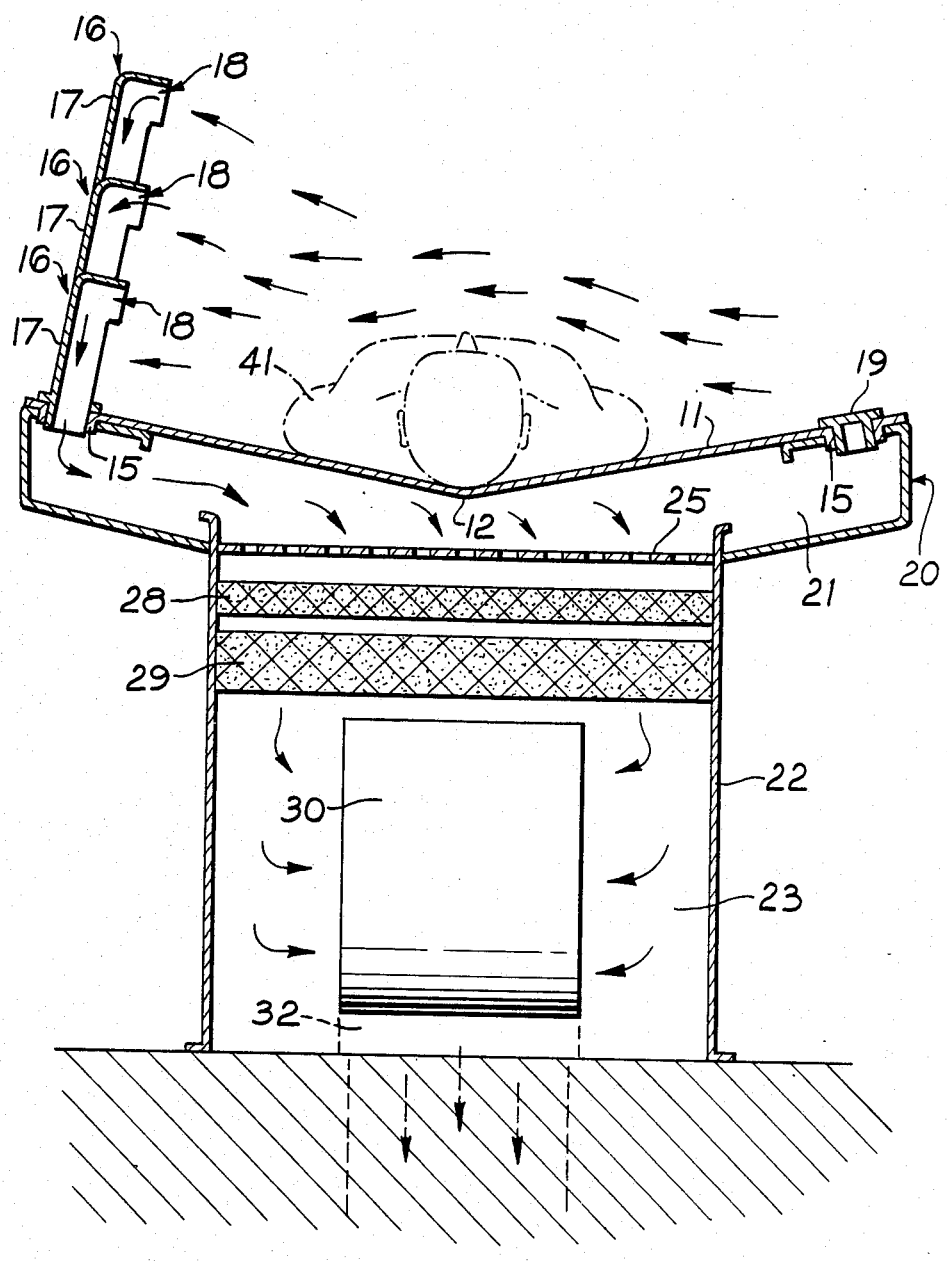
FIG. 2 is a section along the line 2—2 shown in FIG. 1 to a larger scale and the position of a body to be examined is additionally indicated in broken lines.

As shown in FIGS. 1 and 2, a first embodiment of the autopsy table 10 of the invention comprises a substantially rectangular stainless steel table top 11 which is angled along its longitudinal axis 12 and which also slopes downwards along said axis 12 from one end 13 to the opposing end 14. A row of three elongate sockets 15 are located adjacent each longitudinal side of the table top 11. As shown in FIG. 1, a main air entry device 16 comprising an angled plate 17 having end walls extends upwardly from each of the sockets 15 at one side of the table top 11. Devices 16 of different heights are provided and are positioned as required, as will be explained later. Each device 16 has a frontal opening 18 which faces inwardly of the table 10. A respective cover or blanking unit 19 in the form of an inverted channel section is fitted into each of the three sockets 15 at the other side of the table 11 where entry devices 16 are not required.

The sloping table top 11 is superimposed upon a tray 20 thus forming an intervening passageway 21 which tapers along its central axis from the end 13 to the end 14 of the table top 11. The tray 20 is supported upon a housing 22 enclosing a cavity 23, a rim 42 projecting downwardly from the base 24 of the tray 20 fitting neatly around the upper margins of the walls of the housing 22. The base 24 of the tray 20 is perforated in the region 25 which is bounded by the rim 42 and directly overlies the cavity 23. The table top 11 and the tray 20 may be removed from the housing 22 to allow access to filters 28, 29 located in the cavity 23, e.g. for removal and replacement of said filters.

An additional entry device 16 in the form of an angled duct 26 having an upwardly facing opening 27 is located in and extends substantially laterally from a further socket 15 in the side of the tray 20 adjacent the upper end 13 of the plate 11, as shown in FIG. 1.

Filter means in the form of a prefilter 28 arranged above a HEPA filter 29 are located within the cavity 23. Both these filters 28 and 29 extend the full length and breadth of the cavity 23 a short distance beneath and substantially parallel to the base 24 of the tray 20. An extractor fan 30 is located beneath the filters 28 and 29 towards one end of the cavity 23. A duct 31 leads from the fan 30, through a wall of the housing 22 to an exhaust duct 32, terminal flanges of ducts 31, 32 being clamped together.

As shown in FIG. 1, the end 33 of the tray 20 abuts a service unit 34 including a sink 35, provided with hot and cold taps 36 and a drain 37. Beneath the sink 35 is located the aformentioned exhaust duct 32, which is firmly attached to the duct 31. At the central, lower extremity of the end 14 of the table top 11, the table top 11 adjoins the base 24 of the tray 20 and an outlet aperture 38 is provided. A corresponding aperture 39 is located in a sink extension 40 so that any substance e.g. waste fluids draining through the aperture 38 will pass into the sink 35 and thus to the drain 37.

When an autopsy of post-mortem examination of a body 41 is to be carried out upon the autopsy table 10, the body 41 is firstly placed centrally upon the table top 11, as indicated in FIG. 2 with the head at the upper end 13. Alternatively, a tray accommodating the body, on which the body may have been kept in refrigerated storage, may be placed on the table top 11. The devices 16, preferably of three different heights and the covers or blanking units 19 are fitted into or rearranged from one to the other of sockets 15 to give the desired arrangement of entry devices 16 at the most advantageous levels above the table top 11. In the majority of instances it will probably be most convenient to have only covers or blanking units 19 located in the sockets 15 along one side of the table top 11 so as to allow an operator complete access to the body 41 from that side. Location of the devices 16 will depend on which part of the body 41 is to be examined and how high this part is above the table top 11. For example, if a thoracic examination is to be carried out, covers or blanking units 19 will probably be fitted into the sockets 15 along one side of the table top 11 as already mentioned and also into one socket 15 along the other side of the table top 11 adjacent the legs of the body 41. Respective devices 16 will be fitted into the remaining two sockets 15 adjacent the thorax and adjoining regions, the height of the devices 16 being selected so that the top of their openings 18 are approximately level with, or slightly above the upper surface of the thorax.

The aforesaid arrangement of entry devices 16 has been found to be the most favourable to achieve, when the fan is switched on, a transverse flow of air across the part of the body being examined, and away from the operator so that the risk of the latter breathing in noxious substances such as bacteria or gases is minimised.

The angled duct 26 as shown in FIG. 1 is attached at the end of the table 10 adjacent the head of the body 41 whenever the skull is to be sawn so that bone dust may be exhausted.

Before the examination of the body 41 commences, the fan 30 is switched on and it should remain on throughout the course of the examination. The action of the fan 30 is to draw air transversely across the body 41 into the openings 18 of the devices 16 and thus into the passageway 21, through the perforations in the base 24 of the tray 20 and through the prefilter 28 and HEPA filter 29. After passing through the fan 30, the air is forced into the duct 31 and, via exhaust duct 32, to the outside atmosphere. The filters 28, 29 retain any particulate matter, such as bacteria, so that the ducts 31, 32 remain uncontaminated.

Any waste fluids released from the body 41 during the examination together with any irrigating fluids applied will drain down towards the end 14 of the table top 11 and flow through the apertures 38 and 39 into the sink 35 and thus out of drain 37.

The volume of air exhausted via the devices 16 is adjustable by closing off exhaust ports, i.e. sockets 15, when they are not required and/or by adjusting the speed of the fan 30. Extensive smoke and air pattern texts indicate that autopsy tables of the above-described type are microbiologically safer and also more economical in terms of heat energy lost in air exhaustion than any table hitherto known.

After purging with formaldehyde, the abovedescribed table may be disconnected from its service unit 34 for repair of replacement of the filters 28, 29 or the fan 30 by unclamping the duct 31 from the duct 32 and pushing the table 10 away from said unit 34. However, the aforesaid embodiment of the autopsy table of the invention is not especially adapted for movement away from its service unit 34.

Figure 3:
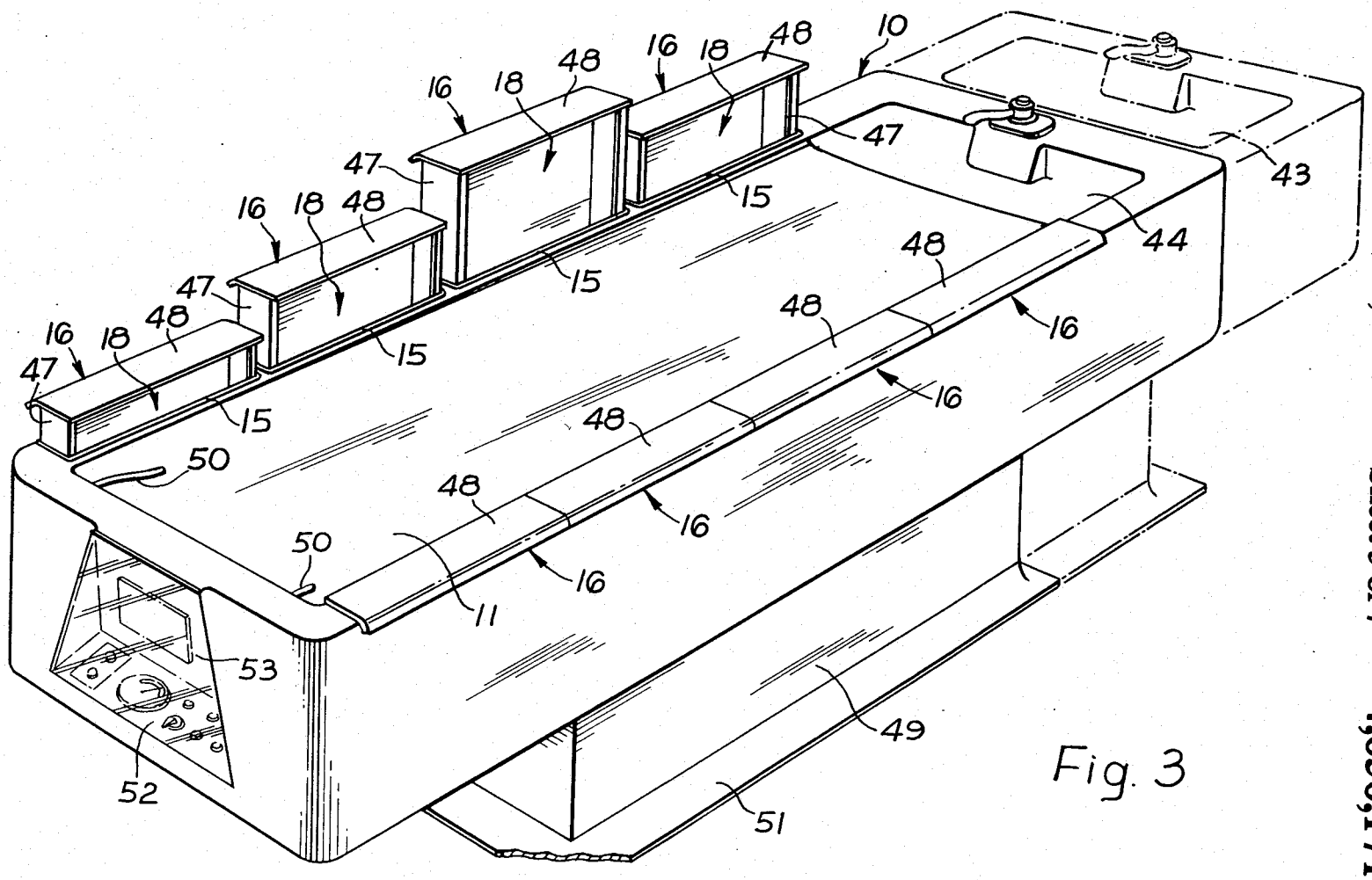
FIG. 3 is a perspective view of a second practical embodiment of the autopsy table of the invention.
Figure 4:
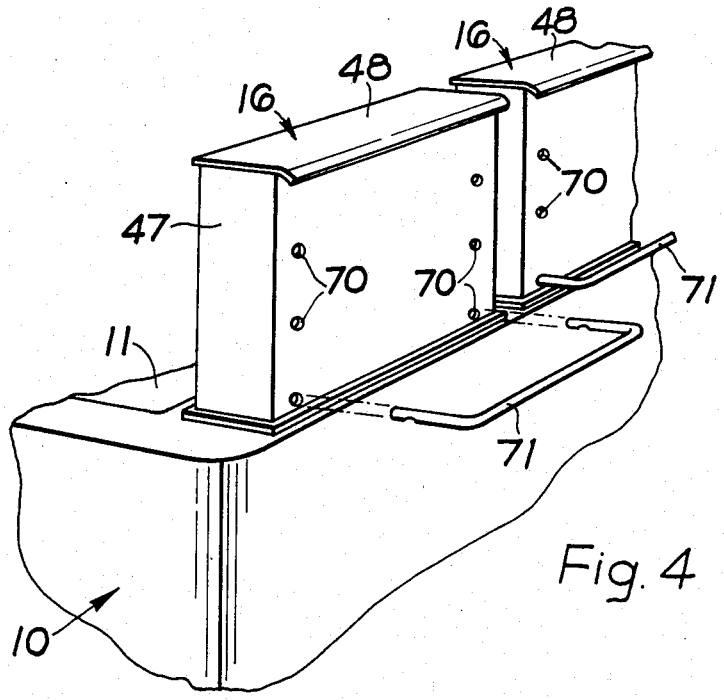
FIG. 4 is a fragmentary perspective view to an enlarged scale illustrating how the air entry devices of the table shown in FIG. 3 may be adjusted in height.

FIG. 3 illustrates a second somewhat modified embodiment of the autopsy table of the invention in which there are four sockets 15 disposed along each side of the table 10 and an exhaust device 16 fitted in each socket 15. In this case, each device 16 comprises a substantially upright fitment 47 having an overhanging top 48 and a frontal air entry aperture 18 facing the table top 11 immediately beneath said top 48. The fitments 47 are all of equal height and are fitted into respective sockets 15 such that the apertures 18 face inwardly of the table top 11. Also, the fitments 47 are slideably adjustable up and down relative to the sockets 15 so that the height of the apertures 18 above the table top can be varied as required. FIG. 4 illustrates how this adjustability is accomplished. Each fitment 47 has, in its side wall opposite to the aperture 18 and facing outwardly of the table top 11, two vertical rows of holes 70, one adjacent each end of the fitment 47. A wide U-shaped bracket 71 is provided having legs which are spaced on appropriate distance apart so as to fit into any pair of holes 70, one from each row at a corresponding height up the wall of the fitment 47. When the legs are thus inserted into an appropriate pair of holes 70, the cross-piece of the bracket 71, which joins the two legs together, projects outwards from the fitment 47 so as to rest on the outer edge of the table top 11 and hold the fitment 47 out of the relevant socket 15 at the level of the chosen pair of holes 70. It will be appreciated that the bracket 71 can easily be pulled out of the holes 70, the fitment 47 slid upwards or downwards as required, and the legs inserted into a different pair of holes 70 so as to alter the effective height of the fitment 47 above the table top 11.

As shown at one side of the table 10 in FIG. 3, when the fitments 47 are fully pushed down, their tops 48, which overhang beyond the side walls, serve to completely block off the sockets 15 so that separate blanking units or covers are not required. However, they may still be used, when convenient in certain circumstances, e.g. if the same sockets rarely require devices with entry apertures.

In this embodiment, the table top 11 is not angled at its mid-line and there is an integral sink 44 at the foot end of the table. Optionally, there may be a second sink 43 and this possibility is indicated in dot-dash lines in FIG. 3.

At the head end of the table 10 there are two small flexible pipes 50 which are used to trickle water along the sides of the table top 11 or another tray placed thereon to wash the work surface both during the autopsy and at other times as required.

The support housing 49 for the table 10 is firmly affixed to the floor by a waterproof covering 51 and exhaust air and other gases are vented downwardly from the table 10 via ducts within the housing 49. A control panel 52 covered by a rigid transparent hinged lid 53 is located at the head end of the table 10 and may include a control knob for adjustment of fan speed, and also a gauge indicating when the filters require to be changed. In other embodiments, such a control panel may, of course, be located at some other position on the table, or remote from the table, e.g. on an adjacent wall.

Apart from the foregoing, this embodiment of the autopsy table of the invention is of similar construction to the first embodiment and it is used in a similar manner. The usual manner of use of the autopsy table has already been described and need not be repeated. However, two possibilities for specialised use of the table shown in FIG. 3 (or the table shown in FIGS. 1 and 2) are illustrated in FIGS. 5 and 6.

Figure 5:
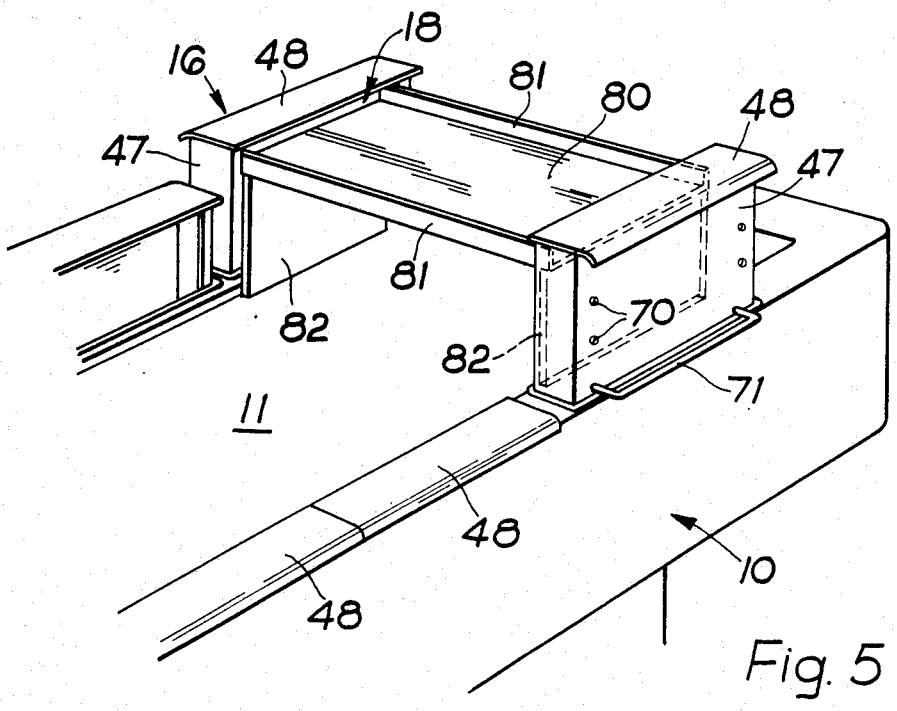
FIG. 5 is a fragmentary perspective view illustrating how a dissecting tray might be used in combination with the autopsy table of FIG. 3.

In FIG. 5 the two opposing air entry devices 47 at the foot end of the table have been secured at a relatively high level above the table top 11 and a dissecting tray 80 has been positioned therebetween. The ends of the dissecting tray 80 are supported upon legs 82 in the form of plates which partially block off the lower parts of the openings 18 of the air entry devices 16. The sides of the tray have respective rims 81. It will be appreciated that during an autopsy, where a particular organ or tissue is required to be dissected, this can be carried out on the tray 80 positioned in the manner illustrated in FIG. 6. Air will be drawn across the tray surface and exhausted via the openings 18 so as to minimise the likelihood of infection of the operator from any bacteria in the material being dissected. The air exhaustion will also reduce noxious odours. Of course, adjustable fitments 47 are not necessarily essential for the table to be used in this way and plates 17 of matching heights, as shown in FIGS. 1 and 2, can be used.

Figure 6:
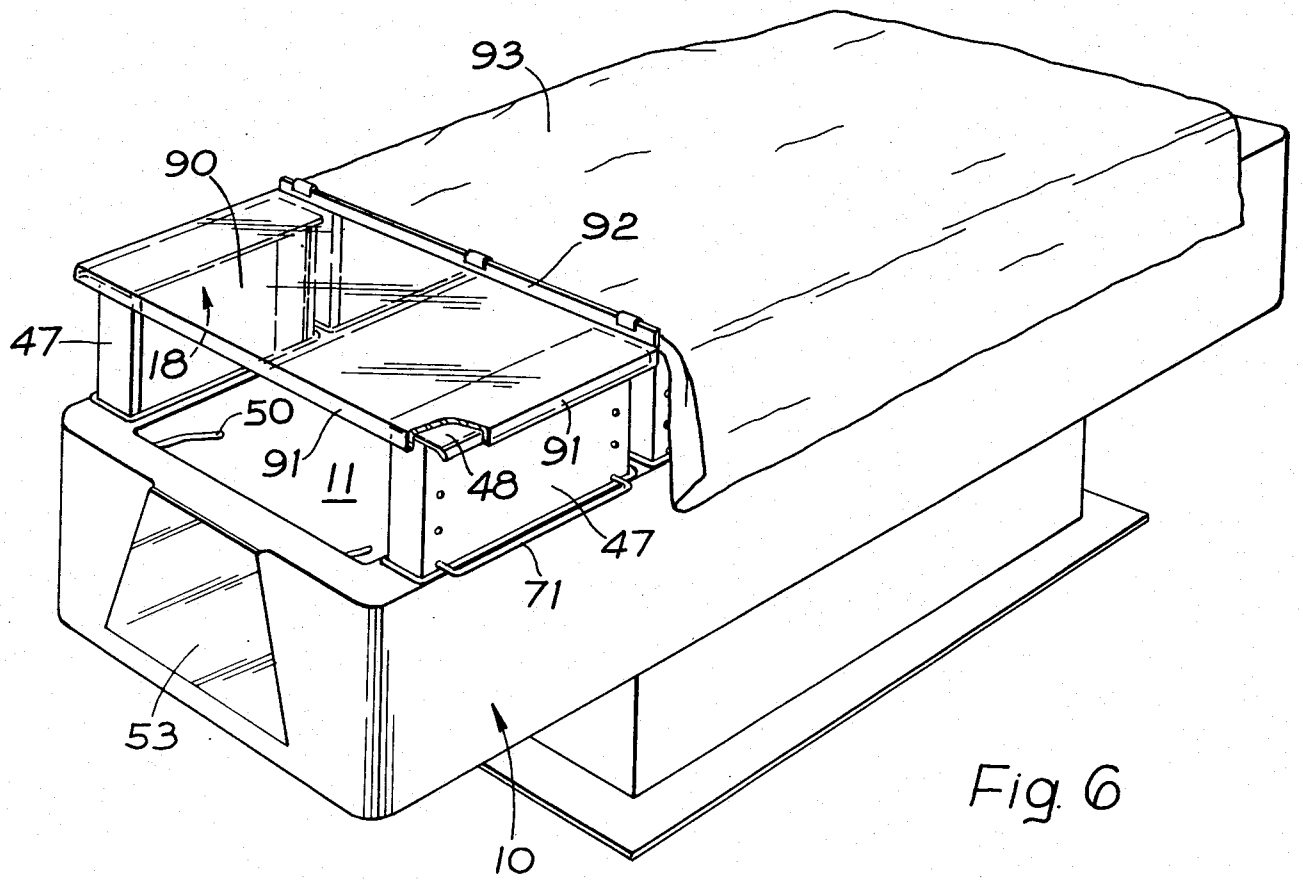
FIG. 6 is a perspective view of the autopsy table of FIG. 3 showing how it may be used in combination with a transparent plate and a sheet of sterile fabric to provide enhanced exhaustion of airborne contaminants.

In FIG. 6, a transparent plate 90, e.g. of perspex, bridges across between the tops of two opposing air entry devices at the head end of the table. The opposing edges of the plate 90 actually rest on the tops 48 of the devices 47. Three sides of the plate 90 have a downturned rim 91 so as to locate snugly on the tops of the devices 47 with minimum likelihood of being dislodged. The fourth side has an upturned rim 92 so that a fabric or paper sheet 93 can be clipped thereto, as illustrated.

The presence of this plate 90 locally increases the rate of air flow and thus enhances the exhaustion of air from the openings 18 of the devices 47 therebeneath, providing, in effect, an air tunnel. This is particularly useful where the body being examined is likely to give off extremely infective contaminants or noxious odours. As illustrated, the tunnel effect can be increased by clipping to the rim 92 a sheet of paper or fabric 93 which is draped over the remainder of the devices 47 all positioned at the same height above the table top 11. The plate 90 needs to be transparent so that the operator can observe the part of the body he is examining. The aforesaid arrangement is particularly practical when the heat is being examined e.g. in cases of suspected death due to meningitis, since the operator can stand at the head end of the table and is not impeded by the devices 47.

Figure 7:
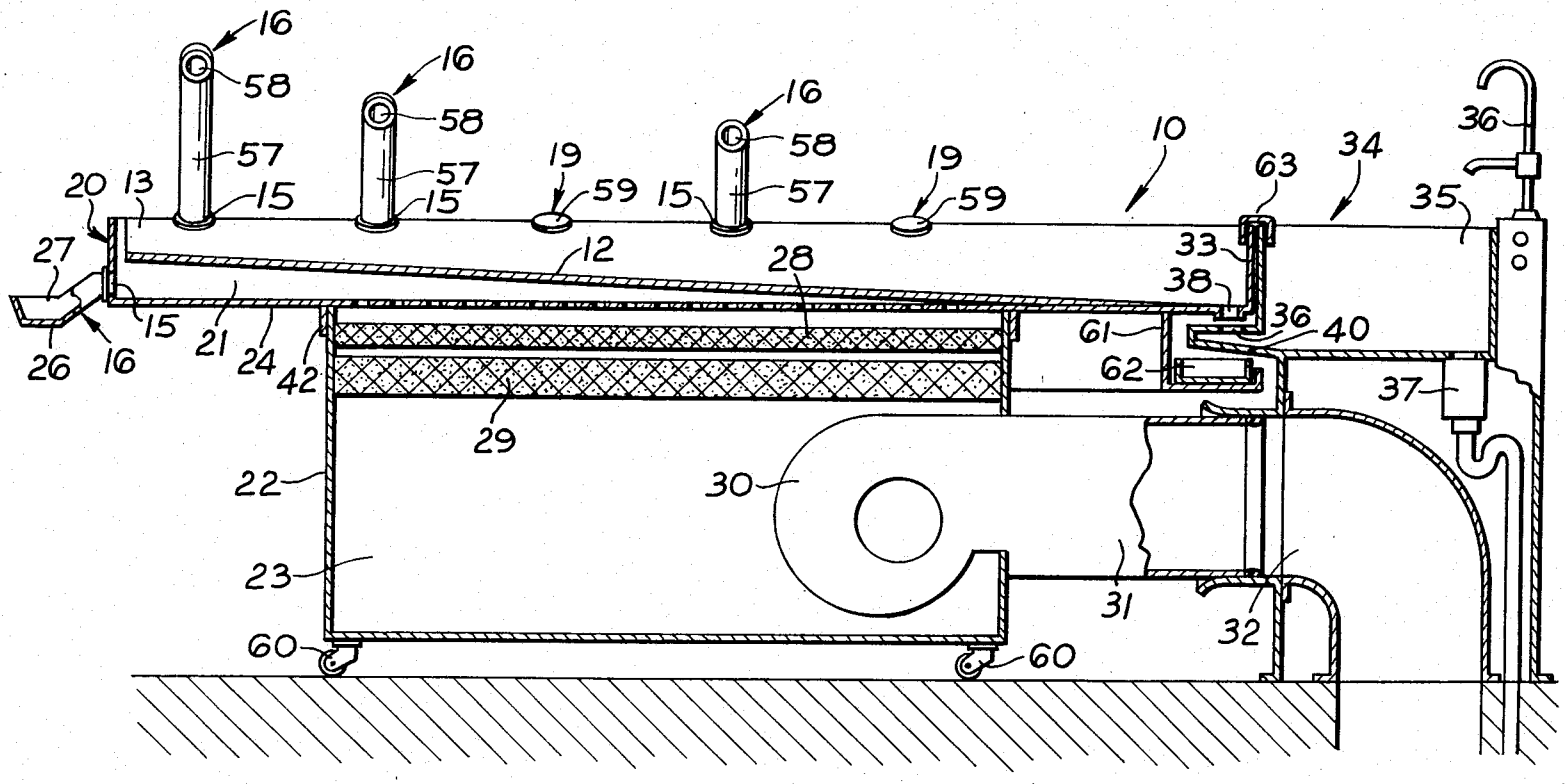
FIG. 7 is a longitudinal cross-section of a third embodiment of the autopsy table of the invention together with a service unit.
Figure 8:
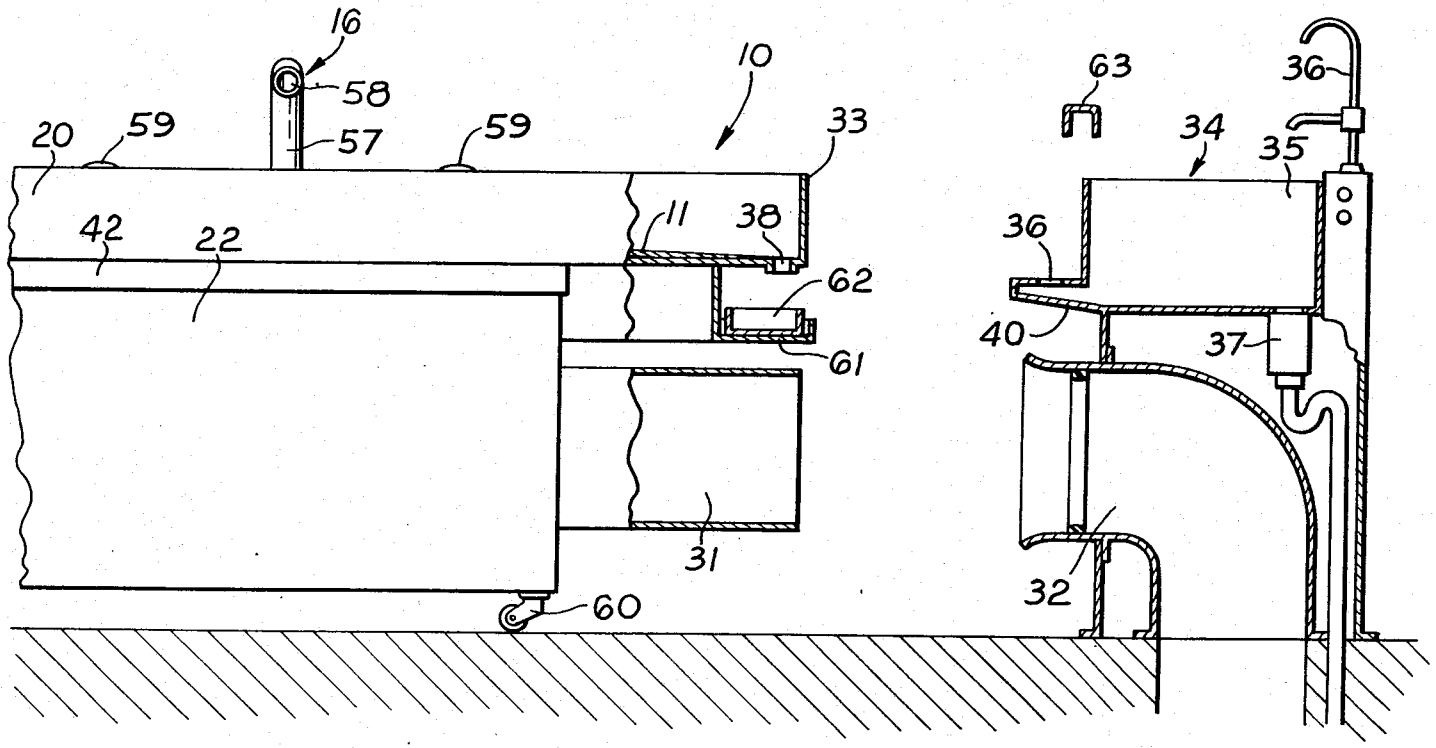
FIG. 8 is a partial cross-section of the embodiment of FIG. 7 showing the table removed from the service unit.

A third practical embodiment of the autopsy table of the invention is illustrated in FIGS. 7 and 8. In this case, five sockets 15 are arranged at equidistant spacings along each longitudinal side of the table 10. The devices 16 are in the form of interchangeable angled tubes or air entry spigots 57 having openings 58, and covers or blanking units 19 in the form of disclike caps 59, are provided.

The remaining construction of the autopsy table 10 and the adjoining service unit 34 and the use of the table are very similar to the description given for the first embodiment hereinbefore described and the same reference numerals as FIGS. 1 and 2 have been used for corresponding parts. However, this third embodiment is specifically adapted for mobility by provision of castors 60 on the base of the housing 22. Also, an L-profiled bracket 61 is suspended from the tray 20 beneath the lower end 14 of the table top 11 and a drip bucket 62 is located on said bracket 61 directly beneath the aperture 38 to catch any fluid draining from the table 10 whenever said table is moved away from the service unit 34. A channel section 63 is additionally provided to link the end 33 of the tray 20 to the side of the sink 35 as and when required and the exhaust ducts 31, 32 are formed so that one can easily slot into the other or be disengaged therefrom.

It is feasible to construct the autopsy table of the invention so as to be removable from an adjacent service unit and disconnectable from the exhaust duct because the provision of filters integral with the table itself means that the disconnected ends of the exhaust duct are substantially clean. In earlier tables where filters were not integral, the exhaust ducts were contaminated.

Although in further embodiments of the autopsy table of the invention air entry devices permanently fixed along one or both sides of the table top may be provided, removable entry devices, as described, are preferable firstly for reasons of access as the operator can decide which side to work from and secondly because only the area of the body being examined needs be exhausted so that volume of air to be exhausted and the energy required to do so may be minimized. This latter point is relevant even when the entire body or trunk is being examined due to the large variation in size of bodies. Furthermore, in certain embodiments non-adjustable air entry devices of only one length may be provided, so that air is exhausted at an average or compromise height for all bodies. Again, this is not as favourable as providing adjustable devices or two, three or more different lengths of removable, interchangeable air entry devices so that differences in the size of bodies may be taken into account and exhaustion at an optimal level achieved.

It should be understood that the foregoing description is illustrative and not limitative of the scope of the invention and variations may be made thereto. In particular a sub-table may be affixed at any point on the autopsy table of the invention, for example for accommodating pieces of equipment, and air entry devices may be appropriately provided in the sub-table or adjacent thereto. Also the table top, the sockets and the air entry devices may be of different shapes and sizes to those described above and a water eliminator may be provided beneath the table top, e.g. adjacent the filters. Furthermore an autopsy table comprising simply a ceramic slab, as described at the beginning of the specification, may be adapted according to the invention by the installation of one or more air entry devices adjacent the slab and an extractor to draw air transversely of said slab into said air entry device or devices.

I claim:

1. An autopsy table comprising:

a box-like housing having tending and non-tending side regions and providing an internal air chamber with an upper surface defining a body supporting table top; an exhaust duct means leading from the air chamber for evacuating air therefrom; rows of sockets arranged in the table top adjacent the sides thereof affording communication between the area above the table top and the air chamber;

a plurality of air entry devices each fitted into one of the sockets of the row of sockets at the nontending side regions of the housing and extending upwardly of the table top and having a frontal opening facing inwardly of the table top for defining a duct for the withdrawal of air from across the area of the table top and evacuation through the air entry devices and into the air chamber and away therefrom via the exhaust duct means;

a plurality of blanking units each fitted into one of the sockets of the row of sockets at the tending side of the housing for blocking withdrawal of air from above the table top through these sockets and into the air chamber, a sheet of substantially rigid material bridging across and above the table top between opposing pairs of the air entry device for locally increasing the flow of exhaust air.

2. An autopsy table comprising:

a box-like housing having tending and non-tending side regions and providing an internal air chamber with an upper surface defining a body supporting table top;

an exhaust duct means leading from the air chamber for evacuating air therefrom; rows of sockets arranged in the table top adjacent the sides thereof affording communication between the area above the table top and the air chamber;

a plurality of air entry devices each fitted into one of the sockets of the row of sockets at the non-tending side regions of the housing and extending upwardly of the table top and having a frontal opening facing inwardly of the table top for defining a duct for the withdrawal of air from across the area of the table top and evacuation through the air entry device and into the air chamber and away therefrom via the exhaust duct means, each of the air entry devices having an overhanging top for blocking off one of the sockets when one of the devices is retracted as far as possible through the socket.

3. An autopsy table as set forth in claim 2 with a plurality of blanking units being provided to block off any of the sockets in which an air entry device is not required to be fitted.

4. An autopsy table comprising:

a box-like housing having tending and non-tending sides and providing an internal air chamber with an upper surface defining a body supporting table top; a filter extending across the air chamber; an exhaust means leading from the air chamber for evacuating air therefrom; rows of sockets arranged in the table top adjacent each side thereof affording communication between the area above the table top and the air chamber; a plurality of air entry ducts of differing heights each fitted into one of the sockets of the row of sockets and extending upwardly of the table top and having a frontal opening facing toward the table top for defining a duct for the withdrawal of air from the area above the table top and evacuation inwardly of the air entry ducts and into the air chamber and outwardly away therefrom via the exhaust duct; blanking units fitted into the sockets of one of the rows of sockets for blocking withdrawal of air from the area above the table top through the sockets and into the air chamber, the air entry ducts and blanking unit being selectively and alternately fitted into the sockets of the rows at the non-tending and tending sides for providing egress of withdrawn air from the area above the table top at one side of the table top and precluding withdrawal of air at the other side of the table top.

5. An autopsy table as set forth in claim 4 wherein castors are fitted to the housing for facilitating easy movement.

6. An autopsy table as set forth in claim 4 wherein the table top is continuous and sloping.

7. An autopsy table as set forth in claim 4 wherein the air entry devices are slidably adjustable relative to the sockets.

8. An autopsy table as set forth in claim 4 wherein filter means are located between the air entry devices and the exhaust duct means.

9. An autopsy table comprising: a box-like housing defining an internal air chamber and having an upper surface providing a substantially rectangular table top; and exhaust duct leading from said chamber; a row of sockets arranged in said table top adjacent each opposing longitudinal edge thereof whereby said table top communicates with said air chamber; a number of air entry devices fitted into said sockets and extending upwardly from said table top each with an opening facing towards said table top for providing ducts for entry of air into said chamber; an extractor disposed in said chamber and operative to draw air across said table top and into said chamber via said devices for exhaustion via said exhaust duct; said air entry devices being slidably adjustable up and down relative to said sockets; and a sheet of substantially rigid material bridging across above said table top between opposing pairs of said air entry devices for increasing locally the flow of exhaust air.

10. An autopsy table comprising: a box-like housing having a substantially rectangular continuous sloping upper surface which provides a table top for reception of a body and defining an internal air chamber; and exhaust duct leading from said chamber; a filter extending across said chamber; a plurality of elongate openings disposed side by side along each longitudinal side of said table top; a plurality of air entry devices of differing heights; a plurality of blanking units, the air entry devices and blanking units being interchangeably fitted into said openings for respectively providing air entry ducts into said chamber and for closing off said openings; an extractor located in said chamber and operative for drawing air across said table top and into said chamber via said air entry devices and through said filter for exhaustion via said exhaust duct; and a sheet of substantially rigid material bridging across above said table top between opposing pairs of said air entry devices to increase locally the flow of exhaust air.

* * * * *